United States Patent [19]

Arora et al.

[11] Patent Number: 4,623,514

[45] Date of Patent: Nov. 18, 1986

[54] LIQUID METAL BRUSH MATERIAL FOR ELECTRICAL MACHINERY SYSTEMS

[75] Inventors: Om P. Arora, Silver Spring; James H. Brady, Bowie, both of Md.

[73] Assignee: The United States of America as represented by the Secretary of the Navy, Washington, D.C.

[21] Appl. No.: 739,656

[22] Filed: May 31, 1985

[51] Int. Cl.[4] ..... C27C 28/00; C27C 30/00

[52] U.S. Cl. ..... 420/555; 420/589

[58] Field of Search ..... 310/178, 219; 420/555, 420/589; 339/5 L, 8 L

[56] References Cited

U.S. PATENT DOCUMENTS

| | | | |
|---|---|---|---|
| 2,649,368 | 8/1953 | Smith, Jr. et al. | 420/555 |
| 2,649,369 | 8/1953 | Smith, Jr. et al. | 420/555 |
| 2,680,071 | 6/1954 | Epstein et al. | 420/555 |
| 3,769,007 | 10/1973 | Stokes, Jr. et al. | 75/166 B |
| 4,083,718 | 4/1978 | Murabayashi et al. | 75/134 D |
| 4,173,468 | 11/1979 | Gault | 75/134 N |
| 4,214,903 | 7/1980 | Murabayashi et al. | 75/134 D |

FOREIGN PATENT DOCUMENTS

| | | | |
|---|---|---|---|
| 136866 | 4/1985 | European Pat. Off. | 420/589 |
| 1401365 | 4/1965 | France | 420/589 |
| 464643 | 7/1975 | U.S.S.R. | 420/589 |

*Primary Examiner*—Christopher W. Brody
*Attorney, Agent, or Firm*—L. A. Marsh

[57] ABSTRACT

A method for transferring current which uses a fusible alloy comprising from about 25.0 to about 48.0 weight percent bismuth, from about 0.8 to about 11.5 weight percent cadmium, from about 18.0 to about 53.5 weight percent indium, from 0.0 to about 24.0 weight percent lead, and from about 9.0 to about 17.0 weight percent tin.

4 Claims, No Drawings

LIQUID METAL BRUSH MATERIAL FOR ELECTRICAL MACHINERY SYSTEMS

BACKGROUND OF THE INVENTION

1. Field of the Invention

This invention relates generally to a means for current transfer, and more particularly, to a means for high current transfer using a Bi-Cd-In-Sn or Bi-Cd-In-Sn-Pb alloy.

2. Description of the Prior Art

High-current-density electrical machinery has extraordinary current collector requirements. Superconducting homopolar motors, for example, which operate at extremely high current densities (approximately 10,000 A/in$^2$ (15.5 MA/m$^2$)) require electrical current collector components capable of handling very large current loads with a minimum of current losses at the collection interface. Solid state brushes, such as graphite and graphite composites, commonly used in conventional motors and generators, are not feasible for use in high-current-density or superconducting motors or generators because of high wear rates and limited current carrying capability. Liquid metals or alloys which are liquid at the operating temperatures of the systems in which they are used, on the other hand, have proved to be viable alternative current collector materials in such machinery.

Ideal liquid metals or alloys for such use would have low melting points, low densities, high thermal stability, high physical stability, high ability to wet the current collector surfaces in machinery in which they are used, low reactivity with oxygen, and low toxicity. In superconducting homopolar motors the rotational forces are such that sufficient liquid metal density is required to retain the alloy in motor channels. High alloy stability under the rotational forces involved would also be a valued characteristic.

Heretofore, mercury, gallium alloys, and a liquid metal eutectic of sodium and potassium containing 78 weight percent potassium and 22 weight percent sodium (NaK-78) have been the materials of choice for use as electric brush material in high current density systems. While these metals generally have low melting points, low densities, and varying ability to wet the current collector surfaces of machinery in which they are used, each has serious shortcomings, NaK-78, like all alkali metals, is highly reactive with oxygen and violently reactive with water. In addition, NaK-78 causes severe burns upon contact with the skin. These properties dictate a need for sophisticated handling procedures and maintenance of a very high purity cover-gas environment. Further, during use in superconducting motors, NaK-78 displays a tendency to migrate from the collector sites and proves unable to wet copper under operating conditions. Likewise, mercury and gallium alloys, both of which have been used in land-based superconducting motors, possess shortcomings in that they are toxic, prone to cause corrosion problems, and unstable under the rotational forces involved in superconducting machinery.

Fusible alloys; usually the binary, ternary, quaternary, and quinternary mixtures of bismuth, lead, tin, cadmium, and indium; are well known in the alloy art for applications where low melting point is a desired property. Examples include Rose's Alloy (Bi 50 weight %, Pb 28 weight %, Sn 22 weight %), Wood's Metal (Bi 50 weight %, Pb 25 weight %, Sn 12.5 weight %, Cd 12.5 weight %), and those alloys provided in U.S. Pat. Nos. 4,083,718 and 4,214,903. Many compositions of eutectic fusible alloys, which have definite and minimum melting points as compared with other compositions of the same metals, are also well known in the alloy art. Although these alloys have numerous known uses, the prior art does not teach composition of a fusible alloy especially suitable for use as a current transport material in high-current-density electrical systems nor does it teach such use of a fusible alloy.

SUMMARY OF THE INVENTION

Therefore, an object of the present invention is to provide a means for current transfer in high-current-density systems.

Another object of the present invention is to provide a means for high current transfer with a liquid metal that has a low density, low toxicity, low reactivity with oxygen and water, and high ability to wet the current collector surfaces of electrical machinery systems.

Yet another object of the present invention is to provide a means for transferring current between the rotor and stator of superconducting homopolar motors and generators with a liquid metal that is compatible with superconducting machinery materials and stable under the hydrodynamic, electromagnetic, and rotational forces present during operation of such systems.

Other objects and advantages will become apparent from the following detailed description and claims.

These and other objects of the present invention are met by contacting points between which it is desired to have current transferred with an alloy comprising, by weight according to total alloy weight, from about 25.0 to about 48.0 percent bismuth, from about 0.8 to about 11.5 percent cadmium, from about 18.0 to about 53.5 percent indium, from 0.0 to about 24.0 percent lead, and from about 9.0 to about 17.0 percent tin; and providing means for containing said alloy so that contact is maintained notwithstanding whether such alloy is in a solid or liquid state.

DETAILED DESCRIPTION OF THE INVENTION

To employ the method of the present invention, an alloy as described below is contained between points between which it is desired to have current transferred. For example, such an alloy could be substituted for NaK-78 in conventional NaK-78 containing channels in superconducting homopolar motors. As another example, such an alloy could be held so as to provide low melting point liquid contacts or elements for fuses in high current electrical systems.

Examples of alloys which may be employed in the method of the present invention are hereinafter described and explained while they are being compared with NaK-78.

Samples of Bi-In-Sn-Cd and Bi-In-Sn-Cd-Pb alloys were prepared by melting in an alumina crucible. Elemental constituents utilized were of high quality (99.98% pure or better). After melting, the alloys were cast in an aluminum dish which served as a mold. The alloys were melted at least five times to make them homogeneous. Solidification characteristics, melting point, density, thermal and physical stability, viscosity, resistivity, and wettability of the individual samples were determined in accordance with the following tests.

SOLIDIFICATION CHARACTERISTICS, MELTING POINT AND DENSITY

Solidification characteristics and melting points were determined by a thermal-arrest analysis method (cooling-curve method). Samples (20 grams) of the alloys were heated in an alumina crucible on a hot plate with a thermocouple (Fe-Constantan) embedded in the melt. Sufficient time was allowed for the melt to come to equilibrium. The crucible with the thermocouple embedded was removed and placed in a hollow cavity made of firebrick material and allowed to cool to room temperature. Duplicate tests were run to confirm the melting points.

Density was determined at room temperature (24 degrees Celsius). The alloys were cast in a cylindrical shape, weighed, and their volumes were determined by displacement of water.

Selected results of the aforementioned tests are shown in Table 1 below.

TABLE 1

| Alloy # | Composition, wt %, Bi | Cd | In | Pb | Sn | Melting Point, degrees Celsius | Density g/cm$^3$ |
|---|---|---|---|---|---|---|---|
| 1 | 40.5 | 10.5 | 18.5 | 20.4 | 10.9 | 42 | 9.33 |
| 2 | 47.2 | 0.0 | 20.5 | 18.0 | 14.5 | 56 | 9.23 |
| 3 | 33.5 | .8 | 46.8 | 1.7 | 17.2 | 56 | 7.78 |
| 4 | 39.1 | 8.3 | 18.0 | 21.8 | 13.0 | 48 | 8.27 |
| 5 | 43.8 | 6.3 | 19.5 | 23.5 | 7.5 | 41 | 9.75 |
| 6 | 25.0 | 11.5 | 53.5 | 0.0 | 9.6 | 52 | 7.80 |
| NaK-78 | 0.0 | 0.0 | 0.0 | 0.0 | 0.0 | −21.6 | .87* |

*at 20 degrees Celsius.

The melting point of each alloy, while not as low as that of NaK-78, is still well below operating temperatures of presently designed superconducting motors and generators (~100 degrees Celsius). The density of the alloys selected ranges from 7.80 to 9.75 g/cm$^3$, considerably higher than that of NaK-78. This higher density could cause some power loss as power loss due to density in unflooded systems is directly proportional to the density of the liquid metal. However, other, more serious power losses; e.g., MHD, ohmic, etc.; lessen the significance of power loss due to liquid metal density. Further, based on experimental evidence and theoretical calculations, it appears that liquids with a higher density than NaK-78 may actually contribute to less power loss as less material migrates from the collector sites during machinery operation and the amount of wetted area is thereby increased.

Alloy number 2, which lacks cadmium, exhibits the least desireable combination of melting point and density. This shows, in part, the criticality of the lower limit of cadmium in the alloys described herein for use in the method of the present invention. Alloys number 4 and number 6, on the other hand, exhibit the best combination of melting point and density. This shows lead to be an optional element and defines a preferred range, for the tested properties, by weight according to total alloy weight, from about 25.0 to 39.1 percent bismuth, from about 8.3 to about 11.5 percent cadmium, from about 18.0 to about 53.5 percent indium, from 0.0 to about 21.8 percent lead, and from about 9.6 to about 13.0 percent tin. Alloys number 1, 2, 3, and 5, with either the highest melting point or with a density over 9.23 g/cm$^3$, all fall outside of this preferred range.

THERMAL AND PHYSICAL STABILITY

Thermal stability of these alloys under static conditions was studied by exposing the liquid metals in air at 75+ or −5 degrees Celsius for a total of 200 hours. The alloys of known weight were contained in a Vycor crucible and heated on a hot plate. Weight changes were measured at intervals of 50 hours. X-ray diffraction studies were made to determine oxidation products formed. Selected results of this test are shown in Table 2.

A miniature rotor-stator assembly was designed to test any physical state change which might occur under rotational and shear forces. The rotor consisted of a hollow glass rod with a long stem connected to a variable speed motor. The stator consisted of a pyrex glass test tube. This maintained a gap of approximately 0.17 cm. The test tube was submerged in a mineral oil bath and heated to the desired temperature. All the tests were conducted in air at 75+ or −5 degrees Celsius. The speed of the rotor was maintained at 400 rpm. Visual examinations were continuously made, and the tests were interrupted when there was evidence of a change in physical state or the speed of the rotor dropped to almost zero. After the tests, chemical composition, melting points, and viscosity measurements were made to compare them with as-cast materials. Selected results of this test are shown in Table 3.

TABLE 2

Physiochemical Properties after Static Oxidation at 75 Degrees Celsius for 200 Hours in Air

| Alloy # | Composition, wt % Bi | Cd | In | Pb | Sn | Weight Change % | Melting Point degrees C. |
|---|---|---|---|---|---|---|---|
| 1 | 39.6 | 10.9 | 19.5 | 19.5 | 11.1 | 0.25 | 37 |
| 2 | 48.3 | 0.0 | 21.4 | 17.9 | 13.0 | 0.15 | 49 |
| 3 | 33.4 | 0.8 | 48.0 | 1.6 | 16.8 | 0.55 | 48 |
| 4 | 39.8 | 8.5 | 18.7 | 21.2 | 11.8 | 1.1 | 42 |
| 5 | 42.8 | 6.6 | 19.3 | 21.8 | 9.4 | 0.9 | 39 |

TABLE 3

Physiochemical Properties after Rotational Simulation in Air at 75 Degrees Celsius

| Alloy # | Composition, wt % Bi | Cd | In | Pb | Sn | Melting Point degrees C. | Time for Change in State/hrs. |
|---|---|---|---|---|---|---|---|
| 1 | 40.5 | 10.2 | 18.6 | 20.7 | 9.7 | 43.5 | 15 |
| 2 | 49.0 | 0.0 | 20.0 | 18.6 | 12.1 | 56.0 | 15 |
| 3 | 35.7 | 0.88 | 45.3 | 1.9 | 16.1 | 58.0 | 13 |
| 4 | 40.5 | 8.8 | 17.3 | 23.3 | 10.0 | 51.0 | 20 |
| 5 | 44.0 | 6.3 | 18.5 | 23.7 | 7.5 | 39.0 | 18 |
| 6 | 25.8 | 11.3 | 53.0 | 0.0 | 9.9 | 51.5 | 22 |

Referring to Table 2, no systematic changes in chemical composition were observed. The changes in composition were within the limits of experimental error (5%–10%) and were not significant, except perhaps for tin. The melting points of the alloys showed a decrease which might have resulted from changes in chemical composition. Total weight changes after 200 hours (which can be considered as the amount of oxidation) were negligible.

Referring now to Table 3, which shows the combined effect of vigorous rotation and oxidation in air on the properties of the alloys, the tests were terminated when the alloy turned to a powdery form or became mush and offered considerable resistance to the rotating shaft. The time of any physical state change ranged from 13 to 22 hours. As observed for the oxidation results, here too the change in composition after testing was not significant and remained within experimental error, except for the case of tin which still showed consistently higher changes in weight than other elements. Melting points of the alloys increased in all cases by 2% to 5% (over as-cast values) which is not very significant.

Alloys number 4 and 6, both having times for change of state exceeding 20 hours, again define a preferred range as stated above. Alloys number 1, 2, 3, and 5, with times for change of state less than 20 hours in every case, fall outside this preferred range. However, as each alloy exhibits a change of state after rotational simulation in air at 75 degrees C., an inert cover-gas system, although not as elaborate as that utilized with NaK-78, would be required for practical use in the method of the present invention. Such a cover-gas system would minimize the significance of differences among the times for change of state described above.

VISCOSITY

Viscosity measurements were carried out in a kinematic viscometer according to ASTM standard D445. The method consisted of melting the alloy in the viscometer and measuring the time for a fixed volume of liquid to flow under gravity through a fine capillary. The viscometer was submerged in an oil bath to maintain a constant temperature. However, because of difficulties encountered in oxidized samples, an alternative method (ASTM-D-2171) was utilized to measure the viscosities. This method differs from the previous one in that it measures absolute viscosity and the kinematic viscosity is calculated from the absolute viscosity and density data. The method consisted of measuring the time required for a fixed volume of liquid to be drawn through a fine capillary tube by means of applied vacuum at the desired temperature. All tests were conducted at 100 degrees C. Kinematic viscosity was calculated using the following formula:

$$\eta = K(H-h)t$$

where $\eta$ = absolute viscosity, cP

H = applied vacuum, 404.1 g/cm$^2$ h = hydrostatic head correction for the test sample (height × density), g/cm$^2$ t = observed flow time, sec K = viscometer calibration constant, cP·cm$^2$/g·sec and $$\eta = \rho\nu$$

where $\rho$ = density, g/cm $\nu$ = kinematic viscosity, cSt.

Table 4 shows the viscosity measurements for both cast and oxidized alloys.

TABLE 4

| Alloy | Viscosity Measurements: Kinematic Viscosity cSt | Absolute Viscosity cP | Temp. °C. | Kinematic Viscosity cSt | Absolute Viscosity cP | Temp. °C. |
|---|---|---|---|---|---|---|
| | Cast | | | After Oxidation for 200 Hours in Air (75° C.) | | |
| 1 | 0.397 | 3.70 | 90 | 0.350 | 3.27 | 100 |
| 2 | 0.382 | 3.53 | 100 | 0.342 | 3.16 | 100 |
| 3 | 0.399 | 3.10 | 100 | 0.233 | 1.81 | 100 |
| 4 | 0.431 | 3.56 | 75 | 0.097 | 0.80 | 100 |
| 5 | 0.340 | 3.31 | 100 | 0.250 | 2.44 | 100 |
| 6 | 0.343 | 2.68 | 100 | — | — | — |
| Nak-78 | 0.643 | 0.505 | 100 | | | |

(1)Kinematic viscosity measured (see ASTM D 455), absolute viscosity calculated.
(2)Absolute viscosity measured (see ASTM D 2171), kinematic viscosity calculated.

Viscosity measurements could not be made on some of the oxidized alloys (nor on any of the alloys obtained after rotational simulation tests) due to minute particles of oxidized products preventing the flow of metal through the fine capillary tube. No attempt was made to measure the viscosity above 100 degrees C. Absolute viscosities of the cast alloys range from 2.68 to 3.70 cP as compared to 0.505 cP for NaK-78. However, the kinematic viscosity, which is more important for the calculations of viscous losses, ranges from 0.34 to 0.43 cSt as compared to NaK-78 kinematic viscosity of 0.6 cSt (estimated). Since the kinematic viscosities as mentioned above are calculated from density data at 24 degrees C., it is believed that if they were corrected to higher temperature they would be comparable to NaK-78, indicating that some of these liquid metals will have about the same fluidity as NaK-78. These alloys do lose viscosity after oxidation and rotational simulation, and no comparison with NaK-78 can be made as NaK-78 does not remain in liquid form after oxidation.

It is noted that alloy number 6 most closely approximates NaK-78 in terms of viscosity. Therefore, based on the tests conducted and described to this point, alloy number 6 constitutes a most preferred alloy for use in the method of the present invention.

RESISTIVITY

Electrical resistivity measurements on cast samples were made at room temperature (24 degrees C.). Samples (20 grams) were melted in a quartz crucible, and a probe was lowered so that it was immersed about 1 cm below the molten surface. The sample was allowed to cool down with the probe immersed in it. A standard four-point probe method as described in ASTM-F-43-71 was used to measure electrical resistivity using current densities from 8 to 100 mA. Both forward and reverse potential drop measurements were made on each sample, and the average potential drop was used for the calculations. The resistivity was calculated as follows:

$$\rho av = \frac{\rho f + \rho r}{2}$$

where $\rho f$=resistivity for forward current $2\pi SV_f/I_f$, $-\Omega-cm$ r=resistivity for reverse current $2\pi SV_r/Ir$, $-\Omega-cm$ S=spacing between probe, cm $V_p$=potential drop across the two inner probes for forward current, volts I=forward current, amperes $V_r$=potential drop across two inner probes for reverse current, volts Ir=reverse current, amperes $\rho av$=average resistivity, $\Omega-cm$ Table 5 shows the results of this test.

TABLE 5

Resistivity Measurements at 24 Degrees C. (solid alloys)

| Alloy | Resistivity $\mu\Omega$-cm | Melting Point degrees C. | Density g/cm$^3$ |
|---|---|---|---|
| 1 | 25 | 42 | 9.33 |
| 2 | 72 | 56 | 9.23 |
| 3 | 45 | 56 | 7.78 |
| 4 | 83 | 48 | 8.27 |
| 5 | 24 | 41 | 9.75 |
| 6 | 22 | 52 | 7.80 |
| NaK-78 | 38 at 20 degrees C. | | |

The bulk resistivity of the alloys varies from 22 to 83 $\mu\Omega-cm$. NaK-78 has an estimated resistivity of 38 $\mu\Omega-cm$ at 24 degrees C. These alloys compare favorably as far as resistivity is concerned, but it can vary considerably, depending upon temperature and contaminaton level.

Electrical resistance (both bulk and contact resistance) is a major factor in the ohmic loss encountered in superconducting systems using liquid metal as brushes or current collectors. Liquid metals, provided they wet the surface of the conductors, are best suited for these systems because they provide low bulk resistance and low contact resistance.

Alloy number 6, the most preferred alloy for use in the method of the present invention, performed favorably overall as far as resistivity is concerned.

WETTABILITY

Wettability was studied by immersing OFHC copper rods (0.3 cm diameter×3 cm long) in liquid metal contained in a Vycor crucible. The crucible was heated on a hot plate to 75 degrees C. in air. All the copper rods were ground, polished, cleaned, and degreased in acetone and alcohol before they were placed in the liquid metal. The shape of the meniscus between the rod and the crucible was continuously observed. After 24 hour exposures, the samples were removed from the liquid metal and cooled to room temperature. Attempts were made to remove the film formed by using both mechanical methods and boiling water to provide qualitative information on wettability and adhesion.

Visual examination for determining wettability indicated that the candidate alloys wet copper very well. Contact angle measurements for determining quantitative values of wettability were not utilized because results involve uncertainties due to sensitivity of the measurements to surface preparation, oxidation, and contamination. Observation of the capillary meniscus indicated that copper is easily wetted by these alloys after a few minutes of immersion. All the alloys formed an adherent film on copper which could only be removed either by using mechanical means or by boiling in water. This is very different from NaK-78 which does not wet copper at the operating temperatures. The film formation observed with these alloys should be extremely advantageous in preventing droplet formation which subsequently will increase the power loss and damage due to arcing. The formation of the film will also help in providing low-contact resistance, excellent heat transfer, and minimal energy losses. Very small amounts (6 cm$^3$) should be sufficient to coat system channels, thus providing adequate contact without exhibiting any tendency towards ejecting at typical (~3500 r.p.m.) system speeds.

It was also noted that the alloys do not cause embrittlement of copper at superconducting operating temperatures. On the other hand, use of NaK-78 in superconducting machinery at typical operating temperatures commonly causes liquid metal embrittlement, manifested by corrosion and grain boundary etching and corrosion.

SUMMARY OF RESULTS

The alloys herein described provide an ideal liquid brush material, especially for high-current-density electrical machinery, and especially when compared to the currently used NaK-78. The viscosity and electrical resistivity of the alloys described are virtually identical with NaK-78; their melting points are comparable. However, these alloys constitute a major advance over NaK-78 for liquid brush material use in that: they oxidize much less rapidly which obviates the need for an elaborate cover gas environment; they exhibit good, as opposed to no, wettability with copper at the operating temperature of superconducting homopolar motors; they can be handled and utilized without the pronounced danger of handling burns and explosions presented by NaK-78; they have higher densities, which should aid in their retention in superconducting motor channels; and very small amounts should be sufficient to coat system channels, thus providing adequate contact without showing any sign of ejection at typical system speeds. Further, the alloys, unlike NaK-78, do not cause embrittlement of copper at typical super-conducting operating temperatures.

It is to be recognized that embodiments, both of alloys and employment of the present invention, other than as described hereinabove are within the scope of the present invention. Although the method of the present invention has been described principally in connection with employment in superconducting machinery, the method of the present invention is applicable wherever it is desired to transfer current, e.g., in normal conducting machines. Further, it is obvious that numerous modifications and variations of the present invention are possible in light of the above teachings. It is therefore to be understood that within the scope of the appended claims, the present invention may be practiced otherwise than as specifically described hereinabove.

What is claimed is:

1. A method for transferring current between at least two points, comprising the steps of:

contacting the at least two points with an alloy comprising, by weight according to total alloy weight, from about 25.0 to about 48.0 percent bismuth, from about 0.8 to about 11.5 percent cadmium, from about 18.0 to about 53.5 percent indium, from 0.0 to about 24.0 percent lead, and from about 9.0 to about 17.0 percent tin; and providing means for containing the alloy so that contact is maintained with each point notwithstanding whether the alloy is in a solid or liquid state.

2. The method of claim 1, wherein the at least two points are located within a high-current-density system.

3. The method of claim 1, wherein the alloy comprises, by weight according to total alloy weight, from about 25.0 to 39.1 percent bismuth, from about 8.3 to about 11.5 percent cadmium, from about 18.0 to about 53.5 percent indium, from 0.0 to about 21.8 percent lead, and from about 9.6 to about 13.0 percent tin.

4. The method of claim 1, wherein the alloy comprises, by weight according to total alloy weight, about 25.0 percent bismuth, about 11.5 percent cadmium, about 53.5 percent indium, and about 9.6 percent tin.

* * * * *